United States Patent [19]

Barnes

[11] 3,940,139

[45] Feb. 24, 1976

[54] OUT-OF-BOUNDS WAND FOR VOLLEYBALL NET AND SUPPORT STRAP

[76] Inventor: Paul J. Barnes, 1859 S. Madison, Denver, Colo. 80210

[22] Filed: Apr. 28, 1975

[21] Appl. No.: 572,158

[52] U.S. Cl. ..... 273/95 R; 248/204; 248/205 R; 248/125; 273/29 B; 273/30

[51] Int. Cl.[2] ..... A63B 71/00

[58] Field of Search ..... 248/40, 125, 204, 205, 248/230, 295, 316 R; 273/95 R, 1 R, 29 R, 29 B, 30; 46/79

[56] References Cited

UNITED STATES PATENTS

| | | | |
|---|---|---|---|
| 1,341,624 | 5/1920 | Wermer | 46/79 |
| 1,888,494 | 11/1932 | Dixon | 248/204 |
| 2,805,277 | 9/1957 | Moeller | 248/125 |
| 3,178,138 | 4/1965 | Hessdoerfer | 248/40 |
| 3,860,240 | 1/1975 | Koch | 273/95 R |

*Primary Examiner*—Paul E. Shapiro
*Assistant Examiner*—Marvin Siskind
*Attorney, Agent, or Firm*—Van Valkenburgh, Lowe & Law

[57] ABSTRACT

An upright rod-like wand attached to the side of a volleyball net at a selected position with respect to the boundary line of the court below the net. A volleyball striking the wand will be out of bounds. The net wand is held in place by a rubber strap having a hole at each end through which the wand is threaded, the wand being at one side of the volleyball net and the strap at the other side thereof.

9 Claims, 6 Drawing Figures

OUT-OF-BOUNDS WAND FOR VOLLEYBALL NET AND SUPPORT STRAP

This invention relates to markers which serve as net boundary or out-of-bounds indicators for ballgames, and more particularly to upright poles or rods which are sometimes called "wands" which will indicate an out of bounds play whenever a wand is struck by a ball.

The present invention is further concerned with an out of bounds indicator for games which require a net, for example, a game such as volleyball where the indicator, a rod or wand, may be mounted at the side of the net to extend upwardly above the net and be struck whenever a ball passing over the net is out of bounds. In the present invention, the rod, or wand, is attached directly to the net and may be called a "net wand". Such a wand is useful for several games, but is especially useful for volleyball games and thus the invention, the net wand, will be described in connection with volleyball.

In a game such as volleyball, the object of the game is to bounce the ball over the net to the opponent, back and forth, until a player misses the ball or until the ball goes out of bounds. The out-of-bounds play may occur if the ball is hit too hard and is projected beyond the limits of the court, or it may occur if the ball is not hit squarely and veers to one side of the net. A volleyball court has a lateral boundary at each side of the net and a rule of the game is that the ball, or at least a portion of the ball, must cross over the net between these lateral boundaries. Often, a ball will pass over the net at a position which is so close to the limit of the lateral boundary that it is next to impossible for an umpire to tell whether or not the ball is, or is not, in bounds. In tournament play or in any other game where the game is serious, this can be important for the whole game may depend upon whether or not a particular pass of the ball was in bounds.

It has heretofore been proposed to use an upright pole standing along each side of the net and properly positioned to indicate an out-of-bounds play whenever the pole is struck. However, the problem in precisely placing and properly securing such a pole can render this expedient more trouble than it is worth.

The present invention was conceived and developed with the foregoing and other considerations in view and comprises, in essence, a wand, a lightweight, strong, resilient rod which is mounted directly upon the net to extend thereabove at a selected position with respect to the boundary line of the court to thus indicate an out-of-bounds play whenever it is struck.

It follows that an object of the present invention is to provide a novel and improved out-of-bounds indicator, an upright wand for a volleyball court, which is of a simple construction and is capable of being attached directly to the net.

Another object of the invention is to provide a net wand for volleyball games and the like which is quickly, easily and securely attached to the net and may also be quickly and easily adjusted to any selected position on the net to correspond with the rules of a game being played.

Other objects of the invention are to provide a net wand for volleyball games and the like which is a simple, economical, neat-appearing, rugged and durable unit.

With the foregoing and other objects in view, my present invention comprises certain constructions, combinations and arrangements of parts and elements as hereinafter described, defined in the appended claims and illustrated in preferred embodiment by the accompanying drawings in which:

FIG. 1 is a perspective view of a fragment of a volleyball court and net showing a lateral boundary marker of the court, an upstanding support at the side of the court, a fragment of a net stretched from the support and a wand constructed according to the present invention affixed to and upstanding from the net, and illustrating further in broken lines an arrangement for positioning the wand on the net at a selected location with respect to the lateral boundary of the volleyball court;

Figure 6:
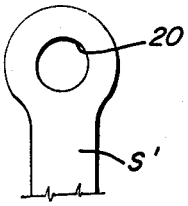
Figure 5:
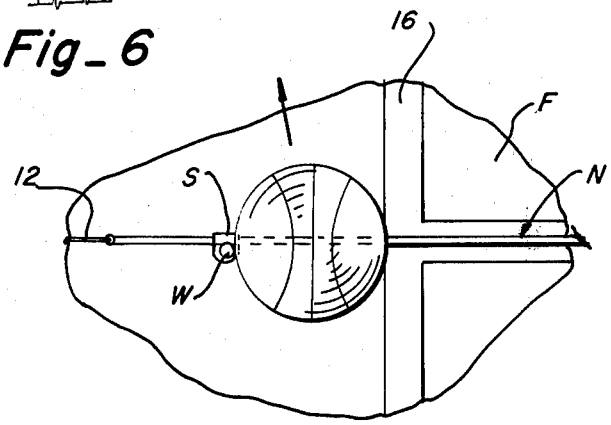

FIG. 5 is a plan view showing a fragment of the volleyball net, the wand mounted upon the net, and a fragment of the volleyball court and its lateral boundary, the view showing further the position of a volleyball moving over the net which is just out of bounds and is striking the wand; and FIG. 6 is a fragmentary view of a portion of a strap modified by showing an enlarged end about the aperture in the strap.

Referring more particularly to the drawing, the improved wand W is illustrated as being mounted upon a volleyball net N by a resilient strap S, as will be further described. The net N is a standard volleyball net having its upper cord 10 and lower cord 11 extended to pull cords 12 of a suitable mounting apparatus 13 carried upon a net post 14. This post 14 is securely held by guy wire braces 15 in any conventional arrangement. In the regular gymnasium, a portion of the floor area beneath the net forms the volleyball court C and the boundaries, such as lateral boundaries 16, are clearly marked upon this floor F. The net post 14 and the guy wires 15 are located to the side of the court and at a position where they are out of the way of the players. The ordinary volleyball net N will be several feet wider than the court and will thus extend a short distance beyond the lateral boundary of the court.

In the present invention, the out-of-bounds wand W is formed as a rod of a selected length, such as 5, 6 or 7 feet, and necessarily greater than the height of the volleyball net. This wand is mounted directly upon this net N to extend thereabove at least several feet, and possibly as much as 3 feet, so as to be struck by a ball hit out of bounds. This rod is necessarily tough, strong and resilient since it is occasionally struck by a volleyball with considerable force. It was found that if a sufficient degree of strength were not incorporated into this wand, it could be bent or broken. A three-eighths or one-half-inch diameter aluminum rod of a strong tempered type of aluminum, such as ST 17, was found to be satisfactory. Other equivalent materials could be used for this wand. A three-eighths or one-half-inch spring steel rod was also found to be satisfactory but undesirably heavy. A small diameter fiberglass rod, although very tough and flexible, could be broken if hit by a volleyball at its connecting point close to the net. Fiberglass rods of sufficient strength are objectionably large in diameter.

The rods selected for a wand could be tapered to be reduced in size in the portion which extends above the net. Also, these rods could be painted or covered with material having different colors to enhance their design and also to facilitate proper placement upon the net N.

Figure 2:
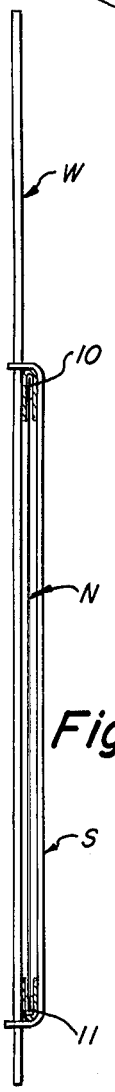
FIG. 2 is a sectional elevational view of the net and the wand attached thereto as taken from the indicated line 2—2 at FIG. 1 but on an enlarged scale.
Figure 4:
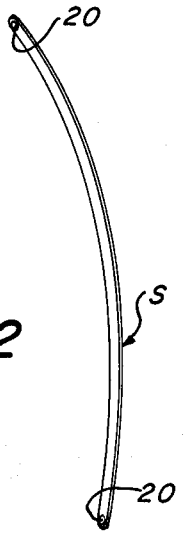
FIG. 4 is a perspective view of a resilient strap used to hold the wand in place.
Figure 3:
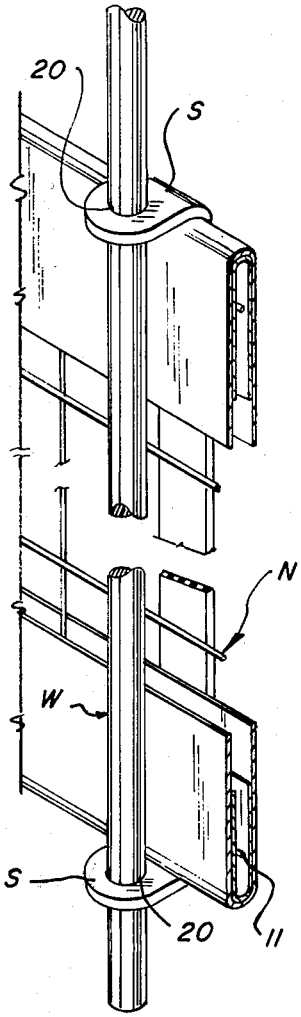
FIG. 3 is a perspective view of a fragment of the net showing the wand attached thereto similar to FIG. 1, but on a further enlarged scale and with portions of the net and the wand structure being broken away to conserve space.

A selected wand W is mounted onto the net by a comparatively heavy, resilient strap S made of rubber or a like resilient, synthetic resin material, such as polyurethane rubber, having a durometer in the range of 40–90 on the Shore-A scale. A suitable strap S was found to be approximately one-eighth-inch thick and 1 to 1½-inches wide. A hole or aperture 20 having a diameter about the same as the rod diameter is formed at each end of the strap to receive the wand. This strap S and the wand W are connected to the net by fitting the wand into the hole 20 at the upper end of the strap and then threading the upper end of the strap onto the wand a distance slightly greater than the height of the net. Thereafter, the wand is placed against one side of the net with a short length projecting below the net, the strap S is placed over the net and against the other side of the net N. Next, the lower end of the wand is fitted into the hole 20 at the lower end of the strap so that the wand and strap snugly embrace the net as in the manner illustrated at FIGS. 2 and 3. The strap is necessarily somewhat shorter than the height of the net to provide for a tight fit under tension. With this arrangement, it has been found that the wand will remain securely in place upon the net when it is being used in a volleyball game. If desired, the ends of the strap may be enlarged about the holes 20 to enhance the strength of the strap, as in the manner illustrated on a portion of a strap S′ at FIG. 6.

Figure 1:
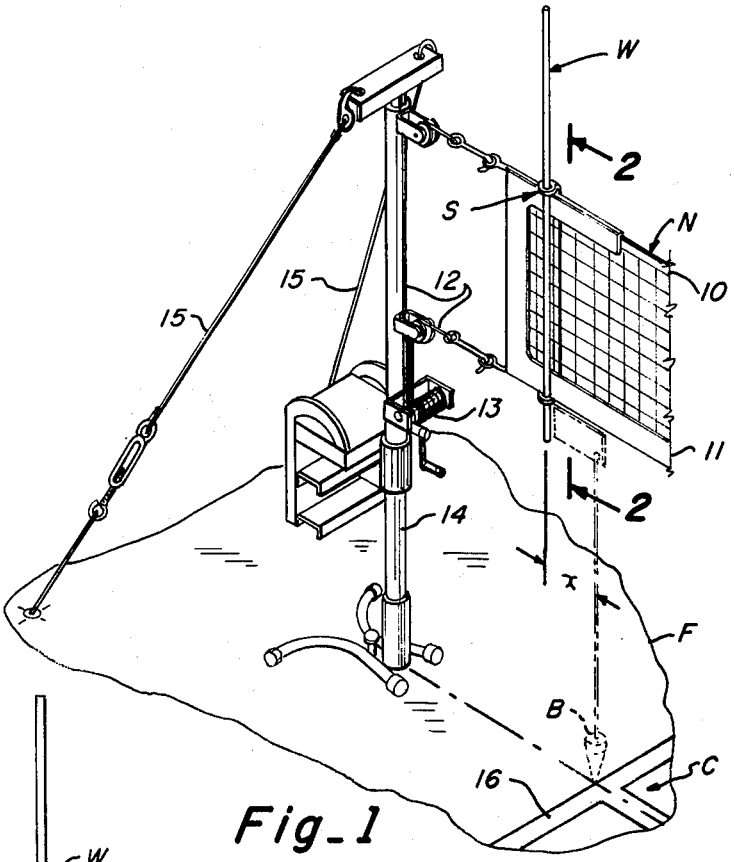

It was discovered that it is a simple matter to properly position a wand with respect to the edge of the court boundary 16 by simply dropping a plumb bob B from the net to the edge of this boundary as shown in dotted lines at FIG. 1. The position of the rod could then be measured from this plumb bob string 21 to any location desired. For example, a desired spacing x of the wand from the lateral boundary is 8½-inches which is the diameter of the ball. When so positioned upon the net, it follows that any time a ball passes over the net at an out-of-bounds location, it will strike the wand no matter how close the ball is to the edge of the boundary. If, however, the ball is within the boundary a very short distance, one-fourth or even one-eighth-inch, where it is not out of bounds, it will not strike the wand. This eliminates guessing by the umpire. If it becomes desirable to modify the rules of the game to place the out-of-bounds line at a different position, such can be accomplished by the simple expedient of shifting the wand along the net to the desired location.

I have now described my invention in considerable detail. However, it is obvious that others skilled in the art can build and devise alternate and equivalent constructions which are nevertheless within the spirit and scope of my invention. Hence, I desire that my prtection be limited not by the constructions illustrated and described, but only by the proper scope of the appended claims.

I claim:

1. An out-of-bounds indicator for a volleyball net, to indicate an out-of-bounds ball flight with respect to the volleyball court during a game, the indicator device comprising in combination with the net:

a. an elongated rod having a length which is greater than the vertical dimension of the volleyball net, b. a narrow, elongated, elastic strap having an aperture at each end sized to fit said elongated rod, said member while in a relaxed condition having a length less than the vertical dimension of said volleyball net, and c. said rod being attached in a vertical position to said net by placing the rod in a vertical position alongside one side of the net and the strap on the opposite side of said net paralleling the rod with said rod being threaded through said apertures above and below said net and with a substantial portion of the rod extending above the top edge of the net.

2. A volleyball out-of-bounds indicator as defined in claim 1 wherein:

a substantial portion of said rod being covered with a colored material to increase the visibility of said rod.

3. A volleyball out-of-bounds indicator device as defined in claim 1 wherein:

a pair of out-of-bounds indicators are attached to the erected volleyball net, each of said indicators being located near opposite ends of the net at a predetermined distance along the net from the point on the net directly above the side boundaries of the volleyball court whereby a volleyball passing over the net and between the indicators without touching the indicators will have at least a portion of the ball lying within the side boundaries of the court.

4. A volleyball indicator device as defined in claim 1 wherein:

the rod is formed from a metallic material.

5. A volleyball indicator device as defined in claim 1 wherein:

said elastic member is formed from a rubber material having a durometer of 40–90 on the Shore-A scale.

6. A volleyball indicator device as defined in claim 1 wherein:

said elastic member is formed from a resilient, synthetic resin.

7. A volleyball indicator device as defined in claim 1 wherein:

the ends of said strap are enlarged about the end apertures so as to reinforce the straps around said apertures.

8. A volleyball indicator device as defined in claim 1 wherein:

said rod has a length which allows the upper portion of the rod to extend at least 3 feet above the top edge of the net.

9. A volleyball indicator device as defined in claim 2 wherein:

said rod covering material has at least two contrasting colors which are arranged in alternating color bands.

* * * * *